US006435072B2

(12) United States Patent
Hirano et al.

(10) Patent No.: US 6,435,072 B2
(45) Date of Patent: Aug. 20, 2002

(54) ROTARY ACTUATOR WITH CUSHION MECHANISM

(75) Inventors: Akihiro Hirano; Kenji Koiwa; Kiyoshi Takeuchi, all of Ibaraki (JP)

(73) Assignee: SMC Corporation, Tokyo (JP)

( * ) Notice: Subject to any disclaimer, the term of this patent is extended or adjusted under 35 U.S.C. 154(b) by 0 days.

(21) Appl. No.: 09/793,575

(22) Filed: Feb. 27, 2001

(30) Foreign Application Priority Data

Mar. 3, 2000 (JP) ..... 2000-058631

(51) Int. Cl.[7] ..... F15B 15/22

(52) U.S. Cl. ..... 91/394; 91/409; 91/357; 92/143

(58) Field of Search ..... 91/394, 396, 357, 91/405, 407, 408, 409; 92/136, 143

(56) References Cited

U.S. PATENT DOCUMENTS 3,138,066 A * 6/1964 Walker ..... 91/408 X
3,150,489 A * 9/1964 Dewar ..... 92/143 X
3,447,423 A * 6/1969 Henry ..... 91/396 X
3,477,177 A * 11/1969 Tucker, Jr. ..... 91/409 X
4,089,251 A * 5/1978 Louviot ..... 91/408 X
4,393,751 A * 7/1983 Kelley ..... 91/408
6,186,043 B1 * 2/2001 Callies ..... 91/408
6,279,451 B1 * 8/2001 Hirano et al. ..... 91/405

FOREIGN PATENT DOCUMENTS

NL 7412949 * 5/1975 ..... 91/394

* cited by examiner

*Primary Examiner*—John E. Ryznic
(74) *Attorney, Agent, or Firm*—Oblon, Spivak, McClelland, Maier & Neustadt, P.C.

(57) ABSTRACT

The invention provides a rotary actuator having a rack driven in an oscillating manner by an air pressure, a pinion engaged with the rack, and a cushion mechanism for stopping the rack to at least one normal or inverse stroke end in a cushioning manner. The cushion mechanism has an exhaust port open to a pressure chamber at a position close to a chamber end rather than a port hole, a flow amount adjusting mechanism for restricting a flow amount of the exhaust air discharged from the exhaust port, and a cushion packing mounted to an outer peripheral surface of the piston and operating so as to shut the port hole from the pressure chamber immediately before the piston reaches the stroke end, thereby discharging the air within the pressure chamber through the flow amount adjusting mechanism.

6 Claims, 6 Drawing Sheets

ROTARY ACTUATOR WITH CUSHION MECHANISM

TECHNICAL FIELD

The present invention relates to a rotary actuator with a cushion mechanism which can stop an oscillating and rotating main axis at an end of a rotational stroke in a cushioning manner.

PRIOR ART

In a rotary actuator generating a rotational force due to an air pressure, there is a rack and pinion type. The rack and pinion type rotary actuator is structured such as to drive a rack in an oscillating manner and rotate a pinion and a main axis fixed to the pinion in an oscillating manner by slidably inserting a piston with the rack into a cylinder tube, engaging the pinion with the rack and applying an air pressure to a pressure chamber sectioned and formed in both sides of the piston.

In the conventional rotary actuator of this kind, in order to absorb an impact force generated by an inertia energy of the piston when the main axis stops at the rotary stroke end, a mechanical cushion mechanism provided with a damper or the like is provided. However, the mechanical cushion mechanism mentioned above has problems that an impact sound is generated at a time of stopping, a deterioration due to abrasion is easily facilitated in the collided portion and parts such as a damper or the like are protruded outward so as to stand in the way. These problems mentioned above can be solved by providing an air pressure type cushion mechanism in place of the mechanical cushion mechanism mentioned above.

As the air pressure type cushion mechanism mentioned above, there has been conventionally known a structure made such as to temporarily seal a cushioning air within a pressure chamber in an exhaust side so as to increase a pressure of the air at a time of operating a piston sliding within a cylinder tube and reduce a speed of the piston by an exhaust pressure so as to stop the piston at a stroke end in a cushioning manner. The structure is made such that an exhaust passage of the air is closed by fitting a cushion ring provided in a piston side into a cushion packing within the cylinder tube in front of the stroke end, the sealed air is introduced to a throttle valve, and a piston back pressure converts a kinetic energy supplied from the piston into an air compression energy in correspondence to a throttle adjusting amount so as to obtain a speed reduction force.

However, in the cushion mechanism utilizing a piston back pressure, since it is required that the cushion ring having a required length is provided in at least one side of the piston and a long empty chamber to which the cushion ring is inserted and fitted is provide in the cylinder tube in view of the structure, the problem that an axial length of the cylinder becomes long is pointed out. Accordingly, when using the cushion mechanism in the rack and pinion type rotary actuator, the rotary actuator which tends to be long in a direction perpendicular to the main axis in view of the structure is further made longer in the direction.

DISCLOSURE OF THE INVENTION

A main object of the present invention is to provide a rotary actuator of a rack and pinion type provided with an air pressure type cushion mechanism.

Another object of the present invention is to structure a rack and pinion type rotary actuator having a large length in a direction perpendicular to a rotational main axis in view of a structure such that the length does not become longer even by attaching the cushion mechanism.

The other object of the present invention is to provide a rotary actuator with a cushion mechanism of a rack and pinion type in which a compact, simple and inexpensive structure can be obtained by omitting a long cushion ring and a long empty chamber to which the cushion ring is inserted and fitted.

In order to achieve the object mentioned above, in accordance with the present invention, there is provided a rack and pinion type rotary actuator having a rack driven in an oscillating manner by an air pressure, a pinion engaged with the rack, and a cushion mechanism for stopping the rack to at least one normal or inverse stroke end in a cushioning manner.

The cushion mechanism mentioned above has an exhaust port open to a pressure chamber for driving the rack at a position close to a chamber end rather than a port hole, a flow amount adjusting mechanism for restricting a flow amount of the exhaust air discharged from the exhaust port, and a cushion packing mounted to an outer peripheral surface of the piston and operating so as to shut the port hole from the pressure chamber immediately before the piston reaches the stroke end, thereby discharging the air within the pressure chamber through the flow amount adjusting mechanism.

In the rotary actuator in accordance with the present invention having the structure mentioned above, the rack is driven in an oscillating manner and the pinion rotates in an oscillating manner following thereto, by alternately supplying the compressed air to the pressure chambers in both sides of the rack from the port. At this time, a speed reducing and stopping operation is performed by the cushion mechanism at the stroke end of the rack in the following manner. That is, the compressed air within the pressure chamber in the exhaust side is at first discharged mainly through the port hole, however, when the rack moves close to the stroke end and the cushion packing moves over the port hole, the port hole and the pressure chamber are shut and the exhaust air from the pressure chamber is discharged in a limited manner through the flow amount adjusting mechanism only from the exhaust port. Accordingly, the pressure of exhaust air within the pressure chamber is increased, and the rack reaches the stroke terminal end while the speed of the rack is reduced due to the back pressure corresponding to the increased exhaust pressure.

Therefore, in accordance with the present invention, it is possible to obtain a rack and pinion type rotary actuator provided with an air pressure type cushion mechanism. Further, since it is not necessary to provide the long cushion ring and the long empty chamber to which the long cushion ring is inserted and fitted, which are provided in the conventional cushion mechanism, it is possible to reduce a length of the actuator in an axial direction of the cylinder at a degree thereof, so that it is possible to obtain an actuator having a compact and simple structure.

In accordance with a preferable embodiment of the present invention, the exhaust port mentioned above is connected to one port via the flow amount adjusting mechanism.

The flow amount adjusting mechanism is formed by a throttle hole for limiting a flow amount of the exhaust air discharged from the pressure chamber mentioned above, and a check valve which prevents the exhaust air discharged from the pressure chamber from flowing but allows a flow of a supplied air flowing into the pressure chamber is provided in parallel to the throttle hole.

In accordance with a particular embodiment of the present invention, a valve chamber connecting the exhaust port to the port is formed in the casing and a hole member having the throttle hole is received within the valve chamber via a lip seal forming the check valve between the lip seal and a chamber wall, whereby the throttle hole and the check valve are assembled within the valve chamber.

The rotary actuator in accordance with the present invention may be of a single rack type having one rack or may be a double rack type having two racks.

In the double rack type rotary actuator, a first pressure chamber and a second pressure chamber are sectioned in both sides of each of two racks, the first pressure chamber of the first rack and the second pressure chamber of the second rack are connected to a first port, and the first pressure chamber of the second rack and the second pressure chamber of the first rack are connected to a second port. Further, two sets of cushion mechanisms are provided for respectively stopping two racks mentioned above to one stroke end in a cushioning manner.

In accordance with a preferable particular embodiment of the present invention, a casing of the actuator has end covers at both ends respectively, two ports mentioned above are provided in one first end cover, the flow amount adjusting mechanism in two sets of cushion mechanisms mentioned above is assembled in another second end cover, the exhaust port open to the second pressure chamber is provided, the port and the flow amount adjusting mechanism are communicated with each other through a through hole formed in the casing, and the port hole is branched from the through hole so as to be open to a hole surface of the cylinder hole.

DETAILED DESCRIPTION

Figure 1:
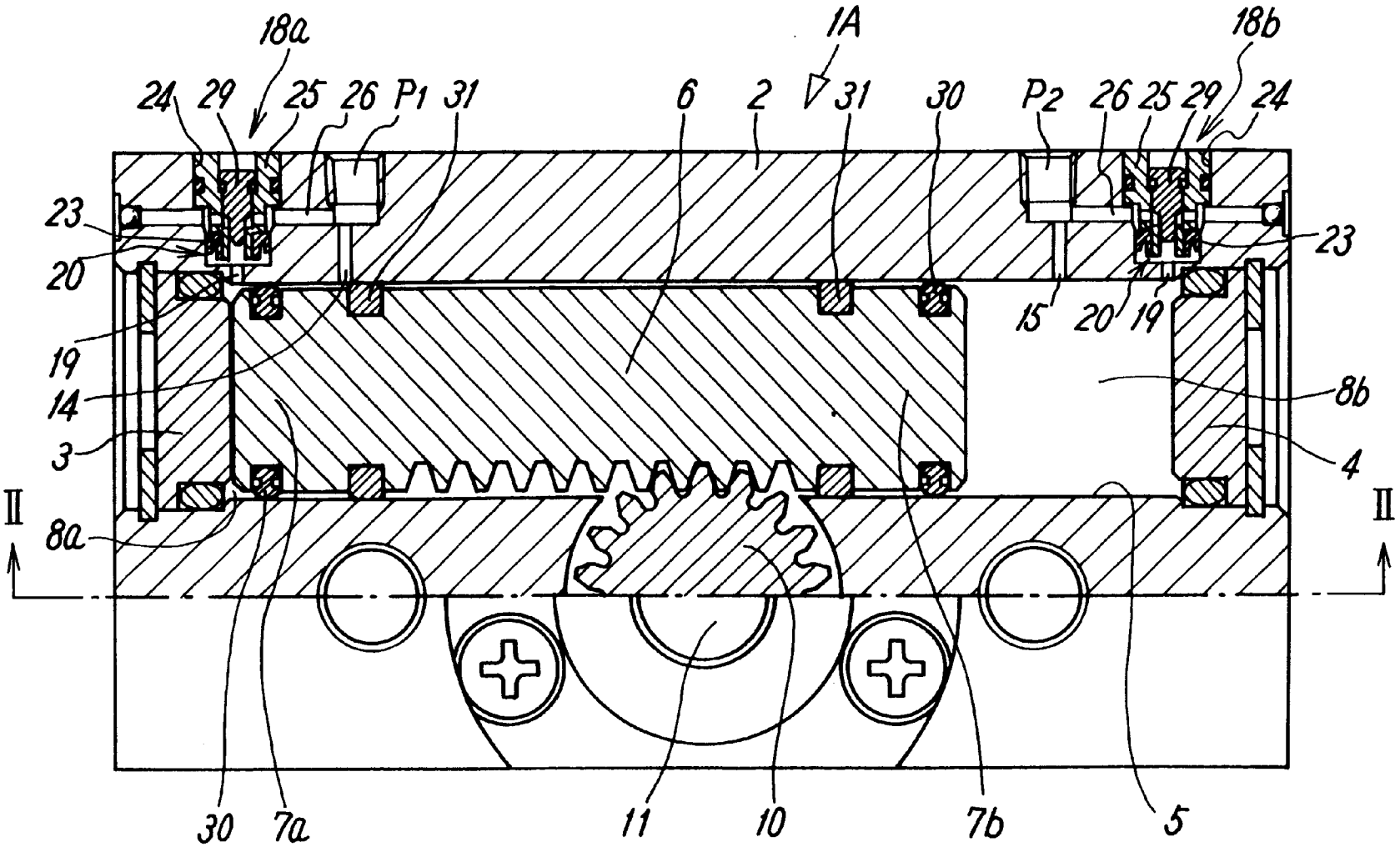
FIG. 1 is a partly cross sectional view showing a first embodiment in accordance with the present invention.

A description will be in detail given below of embodiments in accordance with the present invention with reference to the accompanying drawings. At a time of describing the embodiments, the same reference numerals are attached to the elements having the same functions.

Figure 2:
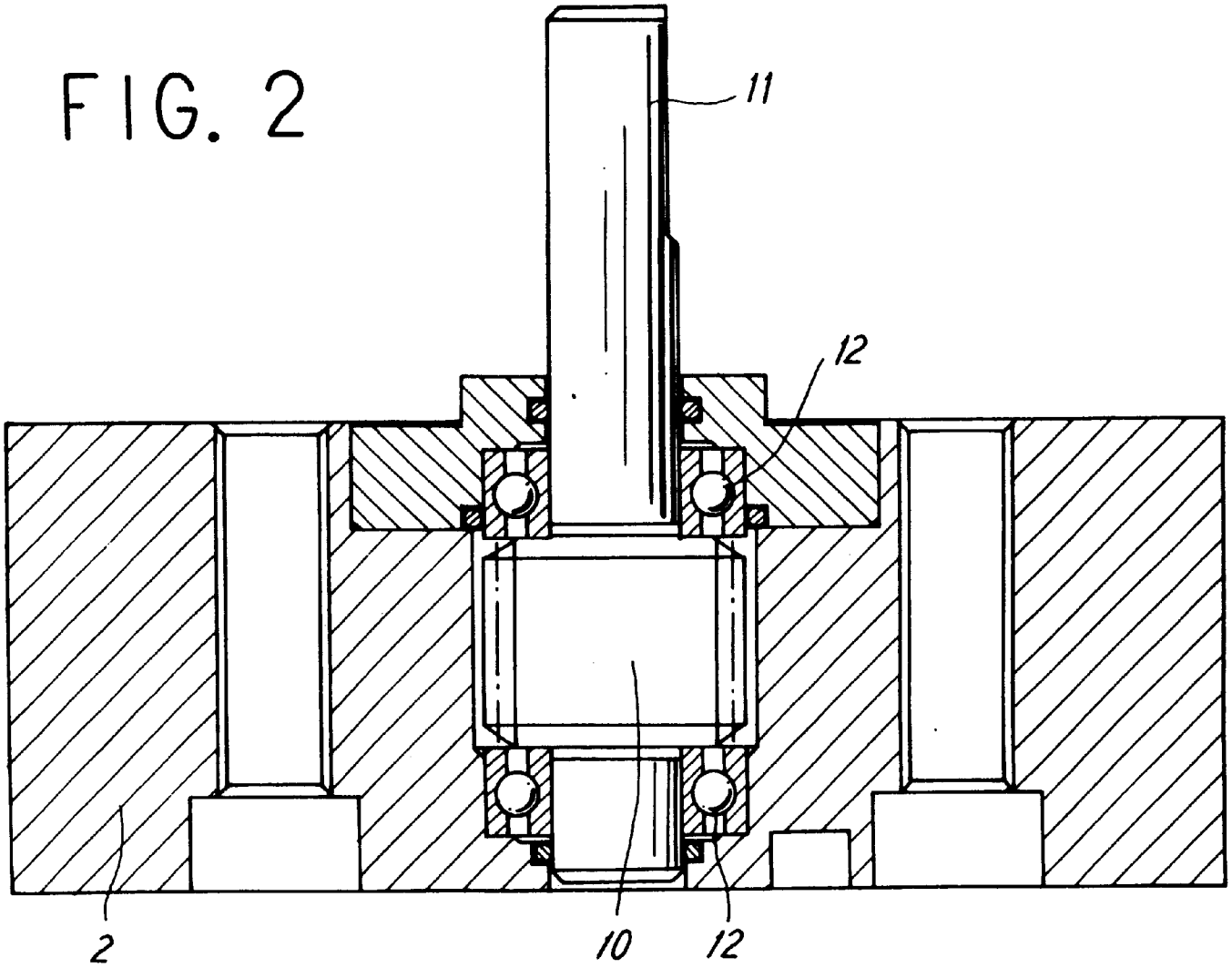
FIG. 2 is a cross sectional view along a line II—II in FIG. 1.
Figure 3:
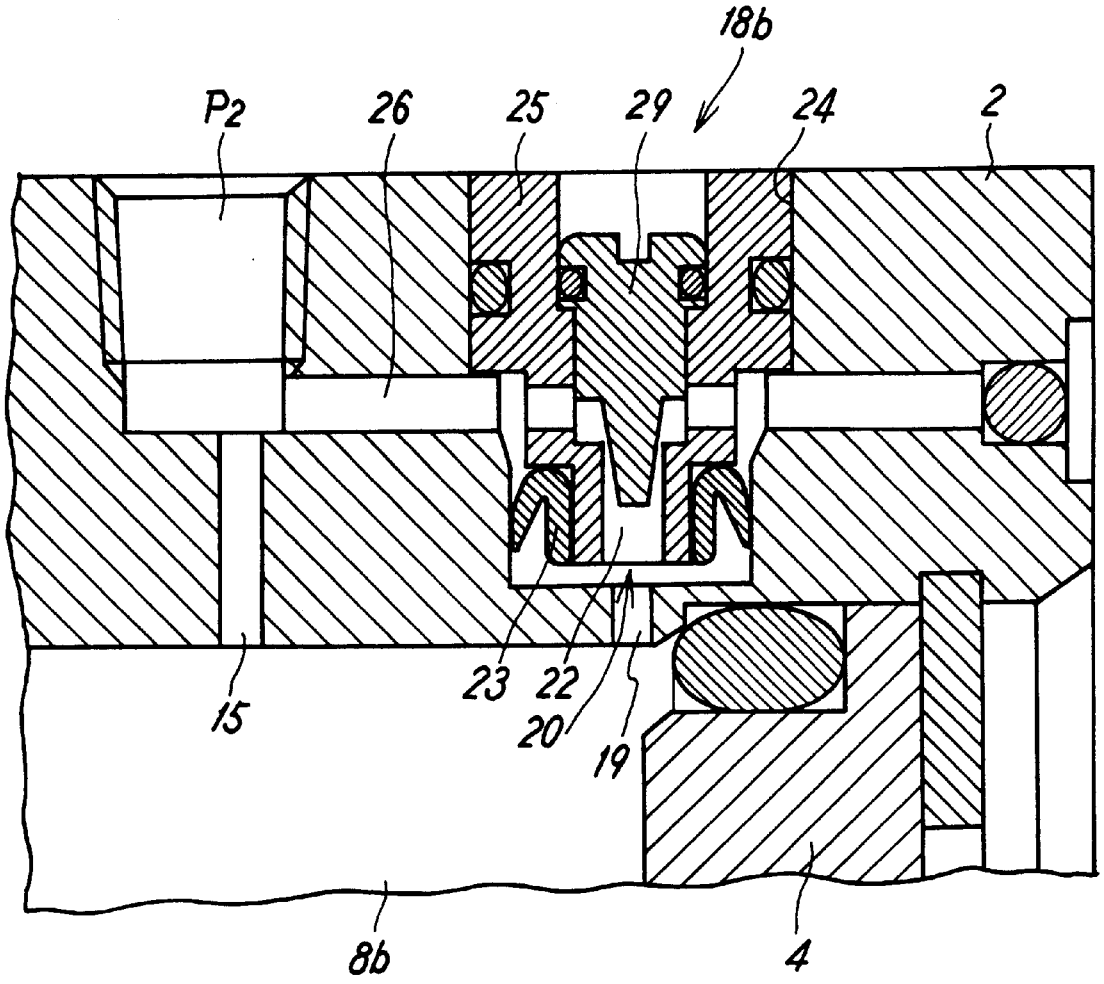
FIG. 3 is an enlarged view of a main portion in FIG. 1.

FIGS. 1 to 3 show a first embodiment of a rack and pinion type rotary actuator in accordance with the present invention, and the actuator 1A is of a single rack type. The actuator 1A has a rectangular casing 2. The casing 2 is provided with one cylinder hole 5 having both ends closed by end covers 3 and 4, a rack 6 sliding in an oscillating manner within the cylinder hole 5 by a first piston 7*a* and a second piston 7*b* which are provided in both ends, first and second pressure chambers 8*a* and 8*b* sectioned and formed in both sides of the rack 6 by the pistons 7*a* and 7*b*, first and second ports $P_1$ and $P_2$ for supplying a compressed air to the pressure chamber 8*a* and 8*b*, a pinion 10 engaged with the rack 6 so as to rotate in an oscillating manner due to the oscillating operation of the rack 6, and a main axis 11 fixed to the pinion 10 and rotatably supported by a bearing 12.

Two ports $P_1$ and $P_2$ mentioned above are provided at positions close to both end portions in an axial direction of a side surface of the casing 2, and respectively communicated with one of two pressure chambers 8*a* and 8*b* mentioned above through port holes 14 and 15 open to a hole surface of the cylinder 5. Further, the rack 6 is driven in an oscillating manner within the cylinder hole 5 together with the pistons 7*a* and 7*b* by alternately supplying a compressed air to the pressure chambers 8*a* and 8*b* from the ports $P_1$ and $P_2$, and the pinion 10 and the main axis 11 fixed thereto are rotated n an oscillating manner in accordance with the operation of the rack 6 mentioned above.

The actuator 1A is further provided with first and second sets of cushion mechanisms 18*a* and 18*b* for stopping the rack 6 to both normal and reverse stroke ends in a cushioning manner.

The cushion mechanisms 18*a* and 18*b* respectively have exhaust ports 19 provided at positions adjacent to one of the ports $P_1$ and $P_2$ and opened to the pressure chambers 8*a* and 8*b* at positions close to the chamber ends rather than the respective port holes 14 and 15, and flow amount adjusting mechanisms 20 provided between the exhaust ports 19 and the ports $P_1$ and $P_2$ and restricting a flow amount of the exhaust air discharged from the pressure chambers 8*a* and 8*b*.

The flow amount adjusting mechanism 20 is formed by a throttle hole 22 restricting a flow amount of the exhaust air as representatively shown by the cushion mechanism 18*b* in the port $P_2$ side shown in FIG. 3, a check valve 23 preventing the exhaust air from flowing without passing through the throttle hole 22 is connected in parallel to the throttle hole 22, and the throttle hole 22 and the check valve 23 are received within the valve chamber 24 formed in the casing 2. That is, the valve chamber 24 communicated with the exhaust ports 19 and the port $P_1$ or $P_2$ is formed on the side surface of the casing 2, a cylindrical hole member 25 in which a diameter thereof is reduced toward a front end step by step is received within the valve chamber 24, the throttle hole 22 is provided in the hole member 25, and a lip seal forming the check valve 23 is interposed between an outer peripheral surface of a front end portion of the hole member 25 and an inner peripheral surface of the valve chamber 24. In the drawings, reference numeral 26 denotes a through hole connecting the port $P_1$ or $P_2$ to the valve chamber 24.

The throttle hole 22 is formed so as to connect the exhaust port 19 to the port $P_1$ or $P_2$, and is structured such that an opening area thereof can be adjusted by a needle 29 mounted to the hole member 25. Accordingly, the throttle hole 22 is of a variable throttle type capable of adjusting a flow amount of the exhaust air.

On the contrary, the check valve 23 is structured such as to prevent the exhaust air discharged from the pressure chambers 8*a* or 8*b* except the exhaust air flowing to the port $P_1$ or $P_2$ through the throttle hole 22 from flowing in a cushion stroke at a stroke terminal end of the rack 6, and to freely flow the compressed air from the port $P_1$ or $P_2$ into the pressure chamber 8*a* or 8*b* at a time of starting the drive operation of the rack 6.

Two inner and outer packings 30 and 31 being in slidable contact with the hole surface of the cylinder hole 5 in an airtight manner are mounted to an outer peripheral surface of each of pistons 7*a* and 7*b* formed in both ends of the rack 6. These packings 30 and 31 has a function corresponding to a piston packing sectioning two pressure chambers 8*a* and 8*b* in both sides of the rack 6, and the packing 30 positioned at an outer side is commonly provided with a function as a cushion packing switching the exhaust air flow passage in addition to the function mentioned above. That is, when the rack 6 is driven in an oscillating manner, the cushion packing 30 of the piston 7*a* or 7*b* in a front side in a moving direction shuts a portion between the pressure chamber 8*a* or 8*b* and the port $P_1$ or $P_2$ in accordance that the rack 6 moves over the port hole 14 or 15 in the exhaust side immediately before reaching the stroke end, thereby discharging the exhaust air within the pressure chamber 8*a* or 8*b* only from the exhaust port 19.

A description will be given of an operation of the rotary actuator 1A having the structure mentioned above. When supplying the compressed air to the first port $P_1$ in a state that the rack 6 exists at one stroke end shown in FIG. 1, the compressed air flows into the valve chamber 24 from the through hole 26, and presses and opens the check valve 23 so as to flow into the first pressure chamber 8*a* from the exhaust port 19, so that the rack 6 starts forward moving toward a right side in FIG. 1.

Further, when the packing 30 outside the first piston 7*a* positioned at a rear side in the moving direction of the rack 6 moves over the port hole 14 of the first port $P_1$, the compressed air is mainly supplied to the first pressure chamber 8*a* through the port hole 14 in a direct manner, so that a moving operation of the rack 6 is continued as it is. At this time, the compressed air within the second pressure chamber 8*b* in the front side in the moving direction of the rack 6 is directly discharged mainly from the port hole 15 through the second port $P_2$.

Further, when the rack 6 moves close to the forward movement stroke end and the packing 30 outside the second piston 7*b* positioned at the front side in the moving direction moves over the port hole 15, the second pressure chamber 8*b* in the exhaust side and the second port $P_2$ are shut, whereby the air within the second pressure chamber 8*b* is discharged from the exhaust port 19 via the flow amount adjusting mechanism 20. In other words, the packing 30 functions as the cushion packing so as to switch the passage of the exhaust air from the state of directly discharging the exhaust air through the port hole 15 and the second port $P_2$ to the state of discharging the exhaust air through the exhaust port 19 and the throttle hole 22 in a limited manner.

Accordingly, the pressure within the second pressure chamber 8*b* is increased in accordance with a flow amount limit by the throttle hole 22 mentioned above, and the increased pressure becomes a piston back pressure so as to take the rack 6 to the stroke terminal end while reducing the speed of the rack 6.

At this time, the cushion packing 30 outside the second piston 7*b* stops in front of the exhaust port 19 and the inner piston packing 31 stops in front of the port hole 15.

In the case of backward moving the rack 6 from the position at the forward moving end, the compressed air is supplied to the second port $P_2$ and the first port $P_1$ is open to the open air. Further, when the rack 6 moves close to the backward moving stroke end in FIG. 1, the packing 30 outside the first piston 7*a* arranged in the front side in the moving direction of the rack 6 functions as a cushion packing so as to switch the discharge passage of the compressed air from the first pressure chamber 8*a* from the state of being directly discharged through the port hole 14 and the first port $P_1$ to the state of being discharged via the exhaust port 19 and the throttle hole 22 of the flow amount adjusting mechanism 20 in a limited manner, so that the rack 6 stops at the backward moving stroke end in a cushioning manner while the speed of the rack 6 is reduced. At this time, the piston packing 31 inside the first piston 7*a* stops in front of the port hole 14.

Accordingly, the compressed air is alternately supplied to the pressure chambers 8*a* and 8*b* from two ports $P_1$ and $P_2$, whereby the rack 6 is driven in an oscillating manner within the cylinder hole 5 together with the pistons 7*a* and 7*b*, and stops in a cushioning manner to the respective stroke ends by the cushion mechanisms 18*a* and 18*b*. Further, the pinion 10 and the main axis 11 fixed thereto are rotated in an oscillating manner in correspondence to the oscillating motion of the rack 6.

Since the rotary actuator having the structure mentioned above does not require the long cushion ring and the long empty chamber to which the cushion ring is inserted and fitted which are provided in the conventional air pressure type cushion mechanism, it is possible to make the length in the axial direction of the rack mechanism in the actuator as short as possible, so that an actuator having a compact size and a simple structure can be obtained.

In the case of stopping the rack 6 only to any one stroke end in a cushioning manner, any one of two cushion mechanisms 18*a* and 18*b* may be omitted.

Figure 4:
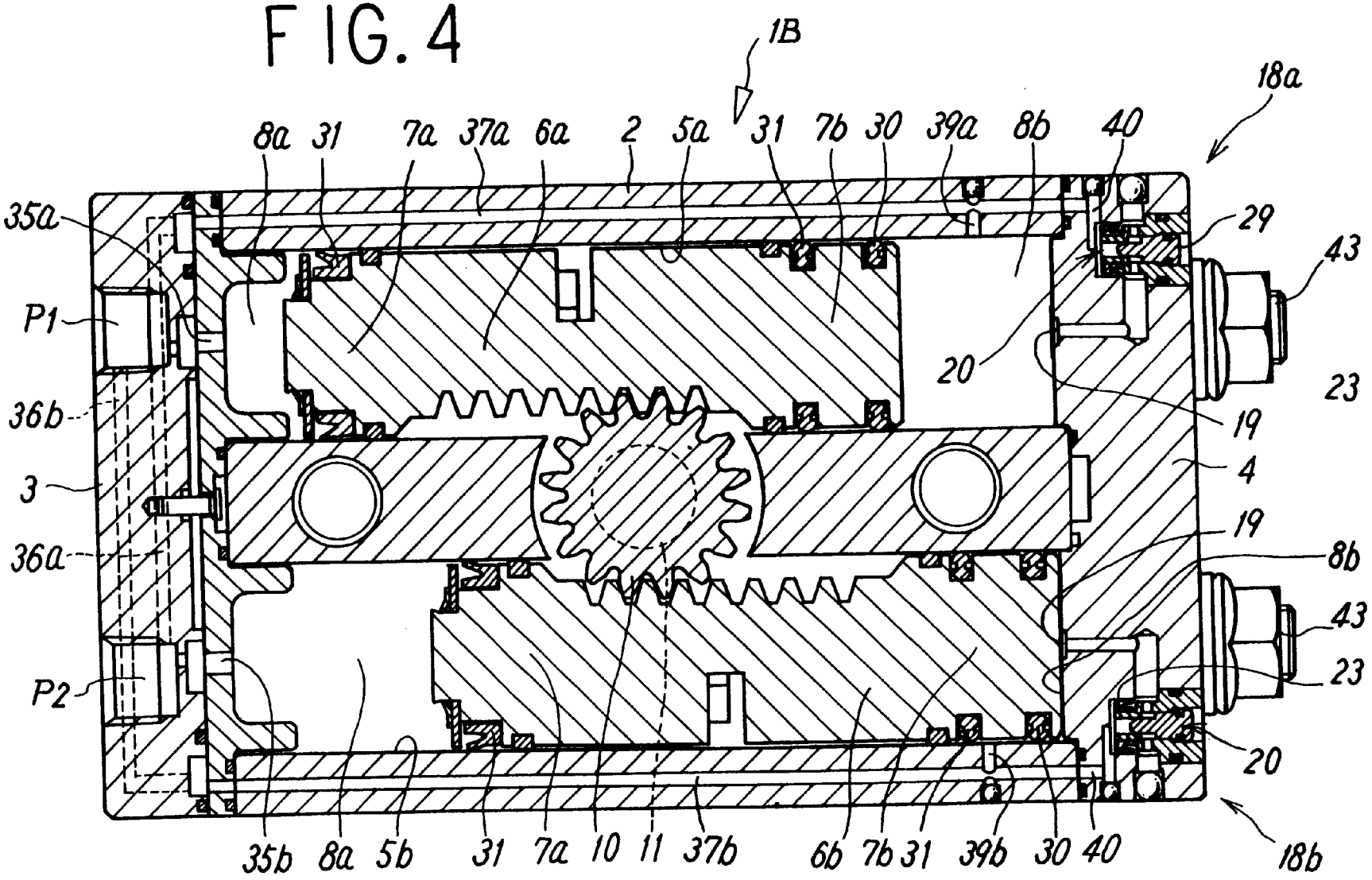
FIG. 4 is a cross sectional view showing a second embodiment in accordance with the present invention.

FIG. 4 shows a second embodiment in accordance with the present invention. The second embodiment relates to a double rack type rotary actuator having two racks.

The actuator 1B is provided with two cylinder holes 5*a* and 5*b* positioned in parallel within the casing 2, and both ends of the cylinder holes 5*a* and 5*b* are closed by a first end cover 3 and a second end cover 4 which are mounted to both ends of the casing 2. A first rack 6*a* and a second rack 6*b* which have pistons 7*a* and 7*b* at both ends are slidably received within two cylinders 5*a* and 5*b* mentioned above, a pinion 10 is engaged with the racks 6*a* and 6*b,* and a main axis 11 is connected to the pinion 10.

A first pressure chamber 8*a* and a second pressure chamber 8*b* are respectively sectioned and formed in both sides of two racks 6*a* and 6*b* mentioned above by the pistons 7*a* and 7*b*, and two ports $P_1$ and $P_2$ for supplying a compressed air to the pressure chambers 8*a* and 8*b* are provided in the first end cover 3. The first port $P_1$ among them is communicated with the first pressure chamber 8*a* of the first rack 6*a* by a through hole 35*a*, and is communicated with the second pressure chamber 8*b* of the second rack 6*b* through a through hole 36*b* provided in the first end cover 3, a through hole 37*b* provided in the casing 2 and a port hole 39*b* open to a hole surface of the cylinder hole 5*b*, and another second pot $P_2$ is communicated with the first pressure chamber 8*a* of the second rack 6*b* by a through hole 35*b*, and is communicated with the second pressure chamber 8*b* of the first rack 6*a* through a through hole 36*a* provided in the first end cover 3, a through hole 37*a* provided in the casing 2 and a port hole 39*a* open to a hole surface of the cylinder hole 5*a*.

Figure 5:
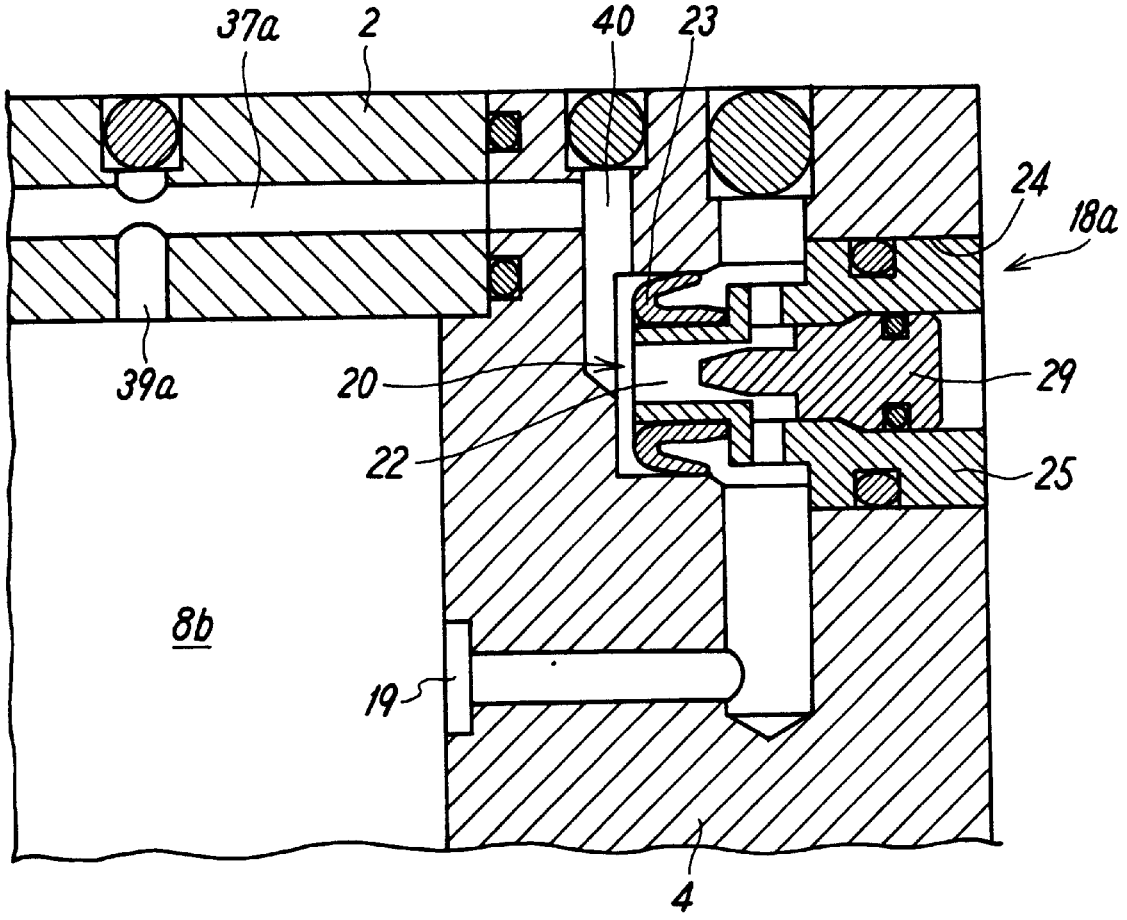
FIG. 5 is an enlarged view of a main portion in FIG. 4.

Further, as is understood from FIG. 5, first and second sets of cushion mechanisms 18*a* and 18*b* for stopping both of the racks 6*a* and 6*b* mentioned above to the respective one stroke end are provided in the actuator 1B, and the exhaust port 19 and the flow amount adjusting mechanism 20 in each of the cushion mechanisms 18*a* and 18*b* are provided in the second end cover 4. Further, the exhaust port 19 of the first cushion mechanism 18*a* corresponding to the first rack 6*a* is open to the second pressure chamber 8*b* of the first rack 6*a*, the exhaust port 19 of the second cushion mechanism 18*b* corresponding to the second rack 6*b* is open to the second pressure chamber 8*b* of the second rack 6*b*, and each of the exhaust ports 19 is connected to the through hole 37*a* or 37*b* within the casing 2 via the flow amount adjusting mechanism 20 and the through hole 40.

In this case, the structure is the same as that of the first embodiment in a point that the flow amount adjusting mechanism 20 is constituted by the throttle hole 22 and the check valve 23 is connected in parallel to the throttle hole 22, however, since the flow direction of the exhaust air passing through the through hole 22 is reverse to that of the first embodiment mentioned above, the direction of the check valve 23 is reverse to that of the first embodiment in correspondence thereto.

Two packings 30 and 31 are mounted to an outer side and an inner side of the second piston 7*b* facing to the second pressure chamber 8*b* among the first and second pistons 7*a* and 7*b* formed in both ends of each of the racks 6*a* and 6*b*, the outer packing 30 is structured such as to function as a cushion packing, and only a lip seal type piston packing 31 is mounted to the first piston 7*a* facing to the first pressure chamber 8*a*.

In the drawings, reference numeral 43 denotes an adjusting screw for adjusting a position of the stroke end of the racks 6*a* and 6*b*. The adjusting screw is screwed at a position corresponding to each of the racks 6*a* and 6*b* of the second end cover 4 so as to face a front end thereof within the second pressure chambers 8*b* and 8*b*, thereby forward and backward moving.

The rotary actuator 1B in accordance with the second embodiment mentioned above is operated as follows. FIG. 4 shows a state that the compressed air is supplied to the second port $P_2$ and the first port $P_1$ is open to the open air. At this time, the compressed air flows into the first pressure chamber 8*a* of the second rack 6*b* via the through hole 35*b* and flows into the second pressure chamber 8*b* of the first rack 6*a* via the through holes 36*a* and 37*a* the port 39*a* so as to move the second rack 6*b* to the forward moving stroke end and move the first rack 6*a* to the backward moving stroke end.

When the compressed air is supplied to the first port $P_1$ from this state and the second port $P_2$ is open to the open air, the compressed air in the first port $P_1$ flows into the first pressure chamber 8*a* of the first rack 6*a* via the through hole 35*a* and flows into the second pressure chamber 8*b* of the second rack 6*b* via the exhaust port 19 from the through holes 36*b* and 37*b* after pushing and opening the check valve 23 so as to forward move the first rack 6*a* and simultaneously move the second rack 6*b* backward, thereby rotating the pinion 10 and the main axis 11 in a clockwise direction in FIG. 4. Further, when the packing 30 outside the second piston 7*b* in the second rack 6*b* moves over the port hole 39*b*, the compressed air is directly supplied to the second pressure chamber 8*b* mainly through the port hole 39*b*.

When the first rack 6*a* moves close to the forward moving stoke end and the packing 30 outside the second piston 7*b* passes over the port hole 39*a*, the second pressure chamber 8*b* and the second port $P_2$ are shut, and the compressed air within the second pressure chamber 8*b* is discharged from the exhaust port 19 via the throttle hole 22 in a limited manner. Accordingly, the first rack 6*a* reaches the forward moving stroke end while the speed of the rack is reduced, and the second rack 6*b* reaches the backward moving stroke end while the speed of the rack is reduced in the following manner.

When the first rack 6*a* reaches the forward moving stroke end, the packing 31 inside the second piston 7*b* stops in front of the port hole 39*a*.

In the case of backward moving the first rack 6*a* and forward moving the second rack 6*b* so as to be set in the switched state in FIG. 4, it is sufficient that the first port $P_1$ is open to the open air and the compressed air is supplied to the second port $P_2$. At this time, the cushion mechanism 18*b* in the second rack 6*b* side is operated, and both of the racks 6*a* and 6*b* stop at the stroke end in a cushioning manner interlocking with each other.

Figure 6:
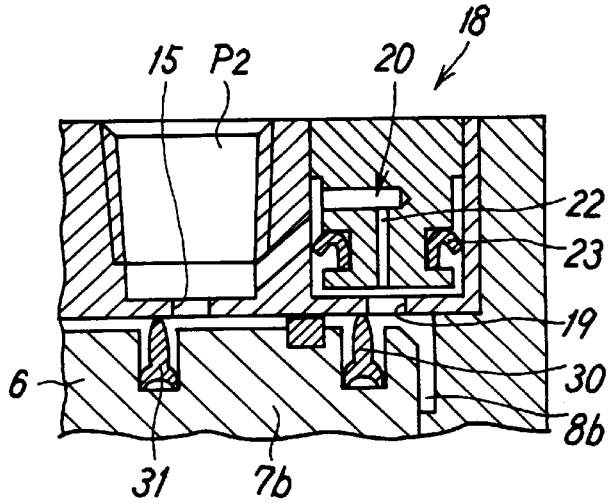
FIG. 6 is a cross sectional view of a main portion showing another embodiment of a flow amount adjusting mechanism.
Figure 7:
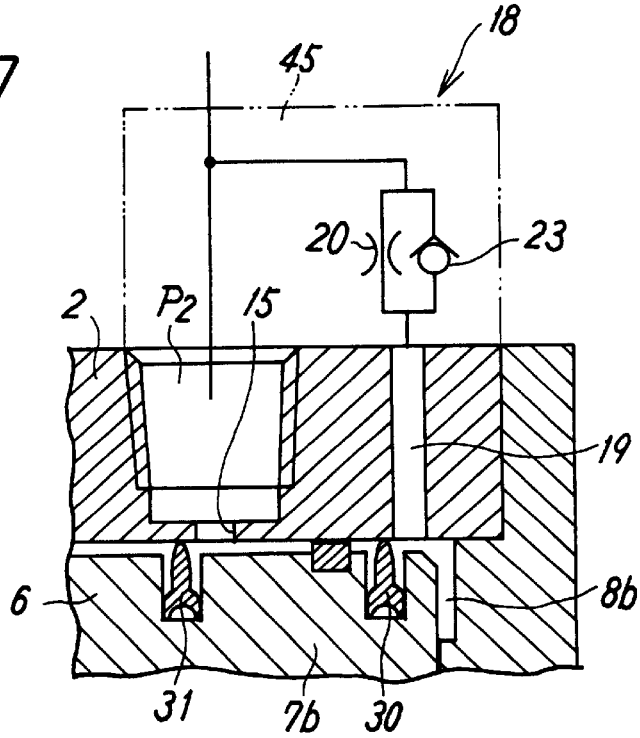
FIG. 7 is a cross sectional view of a main portion showing the other embodiment of the flow amount adjusting mechanism.
Figure 8:
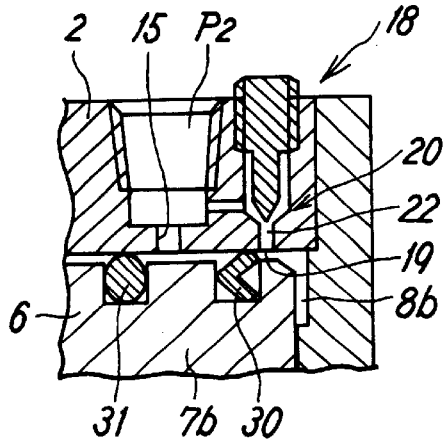
FIG. 8 is a cross sectional view of a main portion showing further the other embodiment of the flow amount adjusting mechanism.

FIGS. 6 to 8 show the other embodiments of the cushion mechanism which can be applied to the present invention. A cushion mechanism 18 shown in FIG. 6 is different from the first and second embodiments in a point that the throttle hole 22 in the flow amount adjusting mechanism 20 is of a stationary throttle type having no needle.

Further, a cushion mechanism 18 shown in FIG. 7 is different from the first and second embodiments in a point that the flow amount adjusting mechanism 20 and the check valve 23 are assembled in a block 45 separated from the casing 2, and the block 45 is attached to the casing 2.

Further, a cushion mechanism 18 shown in FIG. 8 is directly formed in the casing 2 by commonly using the throttle hole 22 in the flow amount adjusting mechanism 20 for the exhaust port 19, an opening area thereof can be varied by the needle, and a part of a plurality of packings 30 and 31 mounted to the pistons 7*a* and 7*b* of the rack 6 commonly has a function of a check valve. That is, the outer packing 30 is formed as a lip seal type packing having a directivity for sealing, and the packing 30 is mounted in a direction allowing a flow of the compressed air toward the first pressure chamber 8*a* side or the second pressure chamber 8*b* side from the inner packing 31 side but preventing a reverse flow of the air.

Accordingly, when the compressed air is supplied to the second port $P_2$ from the state in FIG. 8, the compressed air partly flows into the second pressure chamber 8*b* from the throttle hole 22 but most of the air flows into the outer peripheral gap in the piston 7*b* from the port hole 15 so as to flow into the second pressure chamber 8*b* after pressing and opening the packing 30, so that the rack 6 starts at a desired speed. Further, after the packing 30 passes through the port hole 15, the compressed air directly flows into the second pressure chamber 8*b* from the port hole 15, and thereafter the packing 30 functions as a piston packing for keeping an airtight property of the second pressure chamber 8*b*.

In this case, FIGS. 6 to 8 representatively show the cushion mechanism in the second port $P_2$ side as the examples which can be applied to the first embodiment shown in FIG. 1, however, the cushion mechanism in the first port $P_1$ side has the same structure. Further, in the case of applying the cushion mechanism 18 to the second embodiment shown in FIG. 4, it is a matter of course that the flow amount adjusting mechanism 20, the check valve 23, the exhaust port 19 or the like is provided in the end cover.

What is claimed is:

1. A rotary actuator with a cushion mechanism comprising:

at least one cylinder hole provided in a casing;

a rack having pistons at both ends and sliding within said cylinder hole by the pistons;

a pinion engaged with said rack and a main axis connected to said pinion;

two ports for supplying a compressed air to pressure chambers in both sides of said rack;

a port hole open to a hole surface of said cylinder hole so as to communicate each of said ports with the corresponding pressure chamber; and a cushion mechanism for stopping said rack to at least one normal or inverse stroke end in a cushioning manner, wherein:

said cushion mechanism has an exhaust port open to the pressure chamber at a position close to a chamber end rather than said port hole, a flow amount adjusting mechanism for restricting a flow amount of the exhaust air discharged from said exhaust port, and a cushion packing mounted to an outer peripheral surface of said piston and operating so as to shut said port hole from the pressure chamber immediately before said piston reaches the stroke end, thereby discharging the air within said pressure chamber through the flow amount adjusting mechanism, said flow amount adjusting mechanism is formed by a throttle hole for limiting a flow amount of the exhaust air discharged from said pressure chamber, and a check valve which prevents the exhaust air discharged from said pressure chamber from flowing and allows a flow of a supplied air flowing into the pressure chamber is provided in parallel to the throttle hole, and a valve chamber connecting said exhaust port to the port is formed in said casing and a hole member having said throttle hole is received within the valve chamber via a lip seal forming said check valve between the lip seal and a chamber wall, whereby said throttle hole and the check valve are assembled within said valve chamber.

2. A rotary actuator according to claim 1, wherein said exhaust port is connected to one port via said flow amount adjusting mechanism.

3. A rotary actuator according to claim 1, wherein said actuator is a single rack and pinion type rotary actuator having one cylinder hole and one rack.

4. A rotary actuator according to claim 3, wherein said actuator has two sets of cushion mechanisms and the cushion mechanisms are provided at both end portions of the casing for stopping said rack to both of the normal and reverse stroke ends in a cushioning manner.

5. A rotary actuator according to claim 1, wherein said actuator is a double rack and pinion type rotary actuator having two cylinder holes and two racks.

6. A rotary actuator with a cushion mechanism comprising:

two cylinder holes provided within a casing in a parallel manner;

a first rack and a second rack having pistons at both ends and sliding within each of said cylinder holes by the pistons;

a pinion engaged with said both racks and a main axis connected to said pinion;

first pressure chamber and a second pressure chamber respectively sectioned in both sides of each of said racks;

a first port communicated with the first pressure chamber of said first rack and the second pressure chamber of said second rack, and a second port communicated with the first pressure chamber of the second rack and the second pressure chamber of the first rack; and two sets of cushion mechanisms for stopping said both racks t respective one stroke ends in a cushioning manner, wherein:

said cushion mechanism has an exhaust port open to said second pressure chamber at a position close to a chamber end rather than a port hole connecting said port to the second pressure chamber, a flow amount adjusting mechanism for restricting a flow amount of the exhaust air discharged from said exhaust port, and a cushion packing mounted to an outer peripheral surface of said piston and operating so as to shut said port hole from the second pressure chamber immediately before said piston reaches the stroke end, thereby discharging the air within said second pressure chamber through the flow amount adjusting mechanism, said casing has end covers at both ends respectively, two ports mentioned above are provided in one first end cover, the flow amount adjusting mechanism in two sets of cushion mechanism mentioned above is assembled in another second end cover, the exhaust port open to the second pressure chamber is provided, said port and said flow amount adjusting mechanism are communicated with each other through said first end cover and a through hole formed in the casing, and said port hole is branched from said through hole of said casing so as to be open to a hole surface of the cylinder hole, said flow amount adjusting mechanism is formed by a throttle hole for limiting a flow amount of the exhaust air discharged from said pressure chamber, and a check valve which prevents the exhaust air discharged from said pressure chamber from flowing and allows a flow of a supplied air flowing into the pressure chamber is provided in parallel to the throttle hole, and a valve chamber communicating with said exhaust port and the port is formed in said first end cover and a hole member having said throttle hole is received within the valve chamber via a lip seal forming said check valve between the lip seal and a chamber wall, whereby said throttle hole and the check valve are assembled within said valve chamber.

* * * * *